US006934982B1

(12) United States Patent
Branch, III

(10) Patent No.: US 6,934,982 B1
(45) Date of Patent: Aug. 30, 2005

(54) READING HAMMOCK

(75) Inventor: Jesse A. Branch, III, Winterville, NC (US)

(73) Assignee: Hatteras Hammocks Inc., Greenville, NC (US)

( * ) Notice: Subject to any disclaimer, the term of this patent is extended or adjusted under 35 U.S.C. 154(b) by 0 days.

(21) Appl. No.: 10/842,744

(22) Filed: May 12, 2004

(51) Int. Cl.[7] ..... A45F 3/22

(52) U.S. Cl. ..... 5/120; 122/123; 122/127

(58) Field of Search ..... 5/120–129

(56) References Cited

U.S. PATENT DOCUMENTS

| | | | | | |
|---|---|---|---|---|---|
| 664,774 | A | * | 12/1900 | Palmer | 5/123 |
| 751,102 | A | * | 2/1904 | Palmer | 5/120 |
| 2,745,115 | A | * | 5/1956 | Reiss | 5/122 |
| 4,021,868 | A | * | 5/1977 | Fueslein | 5/123 |
| 5,170,521 | A | * | 12/1992 | Light | 5/118 |
| 5,673,444 | A | * | 10/1997 | Middendorf | 5/127 |

* cited by examiner

*Primary Examiner*—Michael Trettel

(57) ABSTRACT

A hammock is described that has a concave across the mid portion of its hammock bed, a rigid curved bar extending between opposite sides of the hammock bed, beneath its concave, and a flexible strap extending taut between opposite ends of the rigid curved bar beneath the concave.

6 Claims, 1 Drawing Sheet

READING HAMMOCK

FIELD OF THE INVENTION

This invention is directed to a hammock which accommodates one or more users in a quasi sitting posture suitable for reading.

BACKGROUND OF THE INVENTION

Hammocks are an increasingly popular item of outdoor furniture for good reasons. They are inexpensive, readily mobile, resistant to the effects of weather, breezy and comfortably accommodating. One problem inherent to hammocks is their tendency to deform when the weight of a user's body is shifted. For instance, a user wanting to read a book may draw up his legs, bending at the knees and shifting more of his weight to one end of the hammock so that end sinks lower due to gravitational force, and the opposite end rises. It creates an uncomfortable and awkward posture for the user.

It is, accordingly, an object of the present invention to provide an improved hammock that is stabilized across its mid section so as to better accommodate readers and other such who want to use the hammock with their legs bent at the knees and partially drawn in. It is a further object of the invention to provide an improved hammock, the bed of which includes a concave portion.

DISCLOSURE OF THE PRIOR ART

Applicant is aware of no prior art which is directly relevant to the present invention.

SUMMARY OF THE INVENTION

In accordance with the present invention, a hammock bed has a concave portion extending beneath its surface, a rigid curved bar extending beneath the concave and a tensioned strap extending between the opposite ends of the curved bar and beneath the hammock bed.

DETAILED DESCRIPTION OF THE DRAWINGS

Reference will now be made to the preferred embodiment of the present invention, as illustrated in the accompanying drawings.

Figure 3:
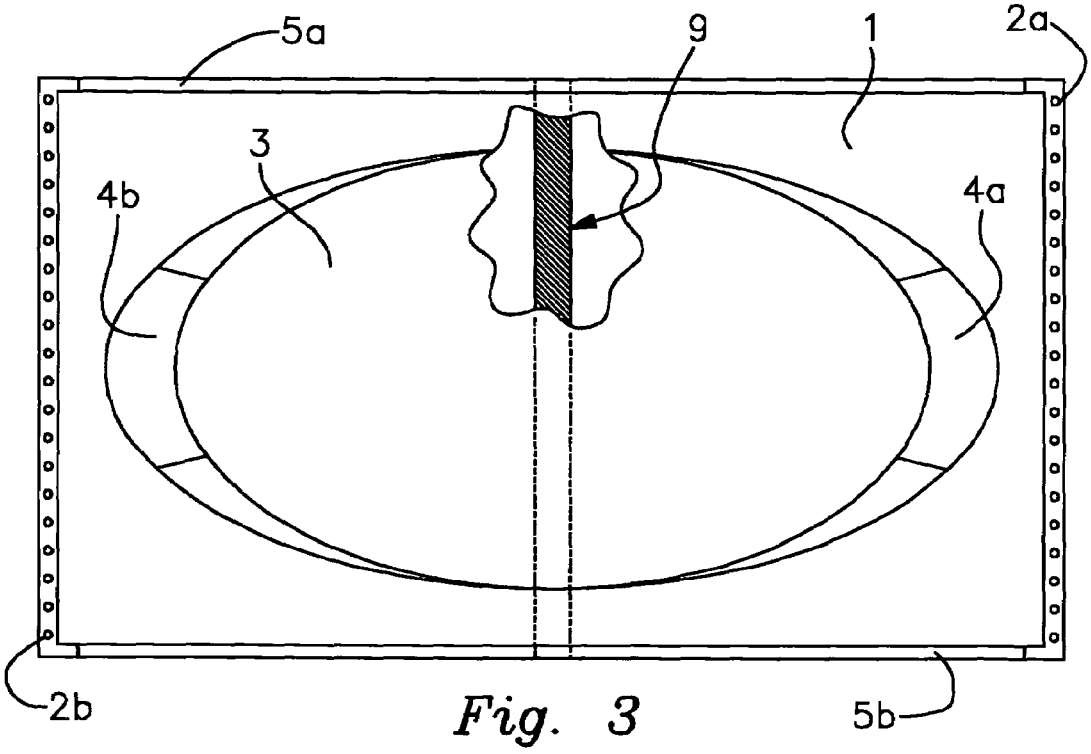
FIG. 3 is a top plan view of the hammock, with the tensioned strap illustrated in phantom lines and through a cut out in the hammock bed.

In FIG. 3, the hammock of the present invention includes a hammock bed 1. On opposite sides of the hammock bed 1, are side hems 5*a* and 5*b*. On opposite ends of hammock bed 1, are clew eyelet holes 2*a* and 2*b*. Standard clew ropes (not shown) are tied to each of eyelet holes 2, and extend through a standard spreader bar (not shown) to a standard terminal ring (not shown), which can be attached to a support structure such as a hammock stand or adjacent trees. The spreader bars function to maintain the eyelets 2, and the ends of the hammock bed in an extended vertical position. This is the standard way in which spreader bars function.

Across the center of hammock bed 1, is formed the concave 3, which extends downwardly from the surface of bed 1 and is oval in shape. On opposite sides of concave 3, are integral cushions 4*a* and 4*b*, which are sewn into the canvas fabric, which comprises the concave 3, and bed 1.

Figure 1:
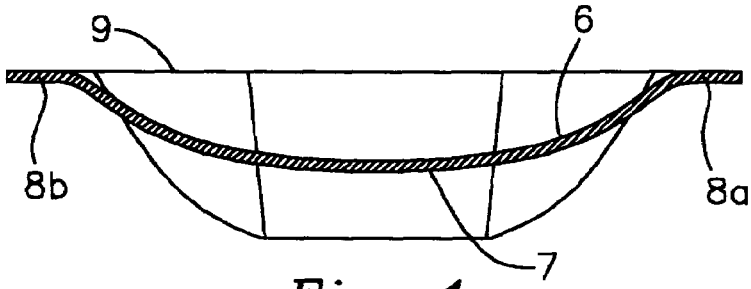
FIG. 1 is a cross-sectional end view of the hammock.
Figure 2:
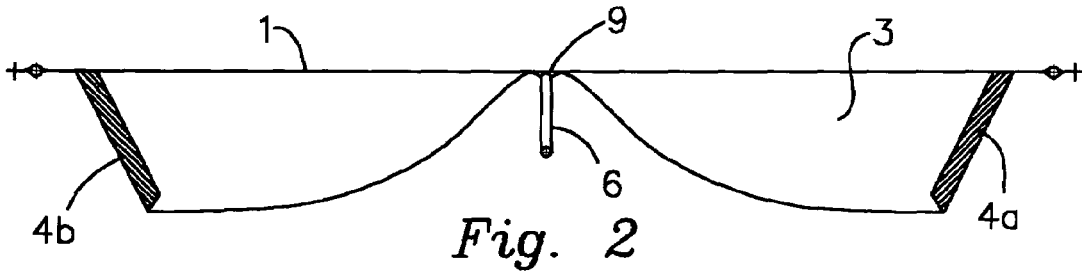
FIG. 2 is a cross-sectional side view of the hammock.

As illustrated in FIG. 1 and FIG. 2, a rigid curved bar 6 extends horizontally beneath the concave 3. The bar 6, has a downwardly bowed section 7, which terminates in upwardly extended ends 8*a* and 8*b*. In the preferred embodiment the bar 6 is formed of aluminum tube; but it could be formed of any relatively rigid and lightweight material. The ends 8*a* and 8*b* are attached underside to hems 5*a* and 5*b* and the portions of bed 1 adjacent thereto. A tensioned canvas strap 9 is attached at its opposite ends to ends 8*a* and 8*b* of the bar 6, and is stretched taut between them and directly under bed 1 and concave 3. It will be appreciated that the strap 9, thus positioned will lift the center portion of concave 3 to approximately the same plane as bed 1.

A user of the reading hammock, can position himself, or herself, in one end of the concave 3 with the user's back is against cushion 4*a* or 4*b*, and the user's legs extend over the raised mid portion of concave 3 so that the underside of the user's knees are over and supported by strap 9. Because strap 9 is of a resilient flexible material, the support it provides yields to the weight applied and therefore it does not cut into the underside of the knees as it would if it were of a rigid material.

It should be appreciated, that the reading hammock can readily accommodate two users, one with its back against cushion 4*a* and the other with its back against cushion 4*b*.

It will be further apparent to those skilled in the art that various modifications and variations can be made in the present invention without departing from the spirit or scope of the invention. Thus, it is intended that the present invention cover such modifications and variations of this invention provided they come within the scope of the appended claims and their equivalents.

What is claimed is:

1. A hammock comprising:

a hammock bed extending between spreader bars at it's opposite ends and support means therefore, a concave extending across the central portion of said hammock bed, a rigid curved bar, attached to opposite sides of said hammock bed and extending beneath said concave, a flexible strap extending taut between opposite ends of said rigid curved bar beneath said concave.

2. The hammock of claim 1, which includes integral cushions at opposite ends of the said concave.

3. The hammock of claim 1, wherein the said hammock bed, concave and said flexible strap are canvas.

4. The hammock of claim 1, wherein the said rigid curved bar is aluminum tube.

5. The hammock of claim 1, wherein said support means is a hammock stand.

6. The hammock of claim 1, wherein said support means are adjacent trees.

* * * * *